United States Patent [19]

Haws

[11] Patent Number: 4,862,724

[45] Date of Patent: Sep. 5, 1989

[54] EXPANDER FOR THIN WALLED METAL PIPE

[76] Inventor: Spencer K. Haws, P.O. Box 315, Mesa, Wash. 99343

[21] Appl. No.: 235,201

[22] Filed: Aug. 23, 1988

[51] Int. Cl.[4] ..... B21D 31/04

[52] U.S. Cl. ..... 72/392; 72/446

[58] Field of Search ..... 72/370, 392, 450, 444, 72/446

[56] References Cited

U.S. PATENT DOCUMENTS

| | | | |
|---|---|---|---|
| 2,916,076 | 12/1959 | Young | 72/392 |
| 3,710,609 | 1/1973 | Jones | 72/392 |
| 3,934,448 | 1/1976 | Hand | 72/392 |
| 4,803,881 | 2/1989 | Dudley | 72/392 |

*Primary Examiner*—Lowell A. Larson

*Attorney, Agent, or Firm*—Keith S. Bergman

[57] ABSTRACT

An expander to repair elongate thin walled pipes or tubes of larger diameter is disclosed. Similar elongate expander beams are pivotally interconnected by plural, parallel articulating links for motion toward and away from each other. One of the beams is longer than the other and carries a hitch structure that is attachable to the ordinary three-point hitch of a wheeled tractor for locomotion, positioning, and powering of the expander. Hydraulic linkage communicates angularly between the expander beams to move them toward and away from each other for use.

4 Claims, 2 Drawing Sheets

20
21
22
19
13
16
22
18
5
31
17
19
14
11
10
28
26
5
14
24
26
15

20
21
16
19
22
13
18
11
31
26
6
27
23
24
19
12
7
26
14
6

15
10
15
14
24
7

20
21
19
22
22
13
16
18
19
35

36
10
11
15

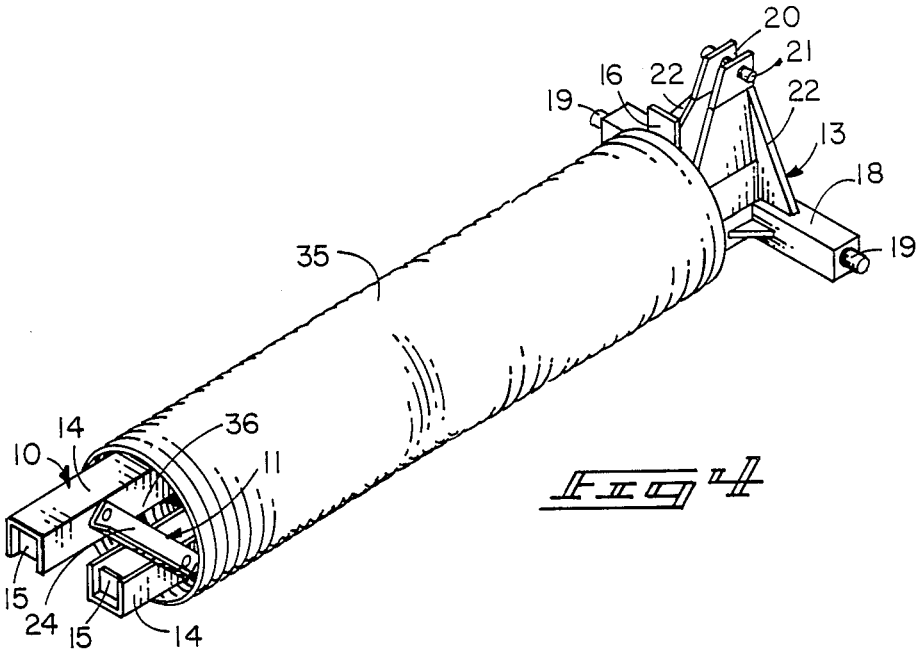
Fig 4
Fig 5
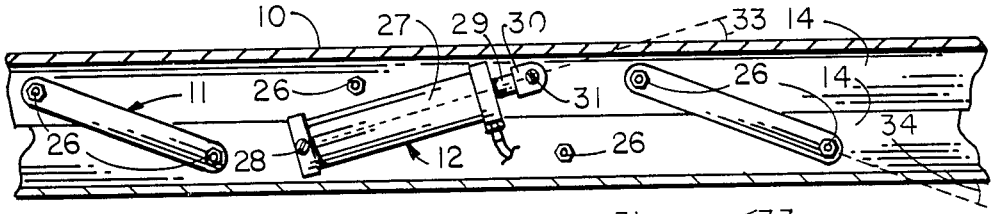
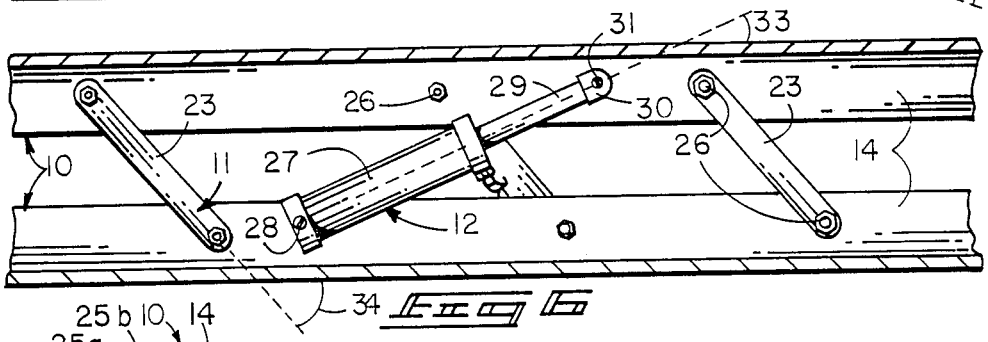
Fig 6
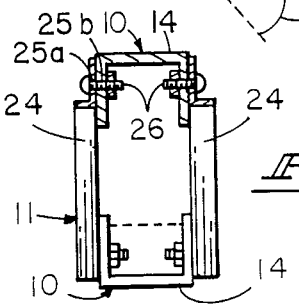
Fig 7

EXPANDER FOR THIN WALLED METAL PIPE

BACKGROUND OF INVENTION

RELATED APPLICATIONS

There are no patent applications related hereto heretofore filed in this or any foreign country.

FIELD OF INVENTION

My invention relates generally to an elongate expanding arbor device for expansion of larger diameter, thin walled metal tube and more particularly to such a device adapted for use with and powering and transportation by a wheeled tractor.

BACKGROUND AND DESCRIPTION OF PRIOR ART

Various types of larger diameter, relatively thin walled pipes or tubes are commonly used and reused, especially in the agricultural and construction arts. These pipes are oftentimes not too physically durable and are quite easily damaged in use or at other times by impact forces, bending loads and the like.

This problem has been dealt with to some degree by modification of the pipe structure itself. Commonly the walls of such pipe are configured variously to increase overall strength and impact resistance, especially by providing alternating bands of indentations and protuberances commonly oriented either in transverse parallel fashion or in spiral array. These pipes structures themselves, however, have not completely resolved the problem of pipe damage and in fact, to some degree exacerbated the situation as they tend to make repair of pipe damage, once it occurs, more difficult.

Various more complex pipe protecting structures have become known to alleviate pipe damage, but these more sophisticated structures have not become commonly accepted or used. These later structures provide such things as multi-walled pipe, often with webs extending between walls; primarily transverse beam-like structures or rods on either the interior or exterior of a pipe; various beam-like structures extending in a direction substantially parallel to the pipe axis; and other similar structures. In general, however, these more sophisticated pipe protectors have been prohibitively costly, oftentimes have disrupted normal pipe function, either per se or in its structural support, and generally have not completely resolved the problem of pipe damage.

Responsively, pipe users have generally turned their attention toward mechanisms that repair damage done to pipe after the damage has occured, and various mechanisms for so doing have heretofore become known. Various of such devices have provided some sort of an elongate compound arbor extendable within or about a damage pipe to move relative to the pipe to exert mechanical force upon it to cause deformation resulting in substantially the original pipe configuration. My instant invention provides a new and novel member of this class of device.

My invention provides a compound elongate arbor formed by two elongate beam-like elements interconnected by pivotal linkage to allow hydraulically powered motion toward and away from each other. This arbor structure allows expansion of diametrically opposed linear portions of a pipe to be repaired and generally may expand indented portions or tend to straighten curved or bent portions of a serviced pipe. It is seldom that pipe to be repaired has protruding damage portions, but if this occurs, it generally may be readily dealt with by impact forces, such as from a hammer, created from the outside of the pipe and in such cases, my arbor structure may also serve as a traditional mandrel.

The linkage interconnecting my two arbor elements provides a plurality of parallel cross-links extending angularly between and pivotally interconnected with the two beam-like elements. This structure provides a simple linkage that allows beam expansion by means of a single hydraulic cylinder extending angularly between the two arbor portions at an angle in the opposite direction to the angle of the cross-links. Prior art devices that have used expandable arbor-type structures have generally provided a complex expanding linkage that is more expensive to manufacture in the inception, provides less maintenance-free service than my linkage and generally may not be operated by a single hydraulic cylinder of either single or double acting variety.

Commonly in using pipe straightening and repair devices, a problem is presented in bringing the pipe and the repair device into association with each other, as both are relatively bulky and massive. Commonly in the past pipe to be repaired has been transported to a distantly stationed repair mechanism. In contradistinction to this procedure, my device is movable to the location of a pipe to be repaired. One of the beams forming the expanding arbor carries hitch structure that is releasably interconnected with the ordinary three-point hitch of small wheeled tractors of present day commerce. My expander may be attached like any other implement to the tractor hitch and the tractor then provides locomoting means for it and also means of moving the arbor structure, at least within the limitations of the hitch motion. This provides substantial convenience not only in moving the expander to a pipe to be serviced, but also in establishing that pipe on the arbor structure, which again can be a difficult operation especially for a single worker.

The association of my expander structure with a wheeled tractor provides an additional benefit in that tractors having three-point hitches have an hydraulic power system which may be used to power the hydraulic means of my expander. Such tractor hydraulic systems commonly are provided with fixtures to releasably interconnect with their hydraulic power systems and my device similarly is provided with a compatible fixture to allow such releasable interconnection. The hydraulic power furnished by the ordinary wheeled tractor hydraulic system is quite sufficient to power the hydraulic means that expands my arbor structure.

The association of my structure with a wheeled tractor for locomotion, positioning and powering provides substantial economic benefits over prior art structures serving a similar purpose and also substantially reduces the bulk and complexity of my expander.

The expanding motion between the arbor portions of my invention is of a compound nature to cause one arbor to move not only perpendicularly away from the other, but also at the same time somewhat linearly which tends to enhance the straigtening motion by creating tensive forces in the pipe parallel to its axis. These elongate tensive forces tend to aid in straightening surface irregularities, whether they be indentations or protuberances, as the forces will tend to stretch the tube in an elongate direction along the area of contact with the arbor portions and this tends to stretch the metal skin of the pipe itself and deform it to its original linear configuration.

My invention resides not in any one of these features or structures per se, but rather in the synergistic combination of all of them that gives rise to the function necessarily flowing therefrom, all as hereinafter more fully specified and claimed.

SUMMARY OF INVENTION

My invention in general provides a pipe expander having similar opposed cooperating expanding beams interconnected by articulating linkage allowing the beams to move toward and away from each other while maintaining parallel relationship. The articulating linkage comprises a plurality of parallel links pivotally connected to each beam in angulated oreintation. The beams are provided for relative motion by an hydraulic cylinder extending therebetween in angulated orientation in a direction opposite that of the connecting links. One expanding beam carries a three-point hitch at a longer end that allows releasable attachment to the three-point hitch structure of an ordinary wheeled tractor. Hydraulic power, expander motion and locomotion are provided by an associated tractor.

In providing such a device, it is:

A principal object of my invention to create a pipe expander having a compound arbor formed by two elongate beams powered to move away from each other in parallel relationship to expand diametrically opposed linear portions of a thin cylinderical walled pipe of larger diameter.

A further object of my invention to provide such a device with a plurality of parallel connecting links communicating angularly between the beams with an hydraulic cylinder angularly communicating between the two beams in the opposite direction to allow powering of the device by a single hydraulic cylinder, while yet maintaining beam parallelity.

A still further object of my invention to provide such a device with one longer carrying hitch structure to allow releasable interconnection with a three-point hitch of a common wheeled tractor for locomotion, positioning and powering.

A still further object of my invention to provide such a device that is of new and novel design, of rugged and durable nature, of simple and economic manufacture and one otherwise well suited to the use and purpose for which it is intended.

Other and further objects of my invention will appear from the following specification and accompanying drawings which form a part hereof. In carrying out the objects of my invention, however, it is to be understood that its esential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 4 is a surface isometric view similar to FIG. 3 but showing my invention expanded to straighten that pipe.

FIG. 5 is a partial elongate vertical cross-sectional view of the device of FIG. 1, taken on the line 5—5 on that Figure in the direction indicated by the arrows.

FIG. 6 is a partial elongate vertical cross-sectional view of the device of FIG. 2, on the line 6—6 thereon in the direction indicated by arrows.

FIG. 7 is a transverse vertical cross-sectional view of the device of FIG. 2, taken on the line 7—7 thereon in the direction indicated by the arrows.

DESCRIPTION OF THE PREFERRED EMBODIMENT

Figure 1:
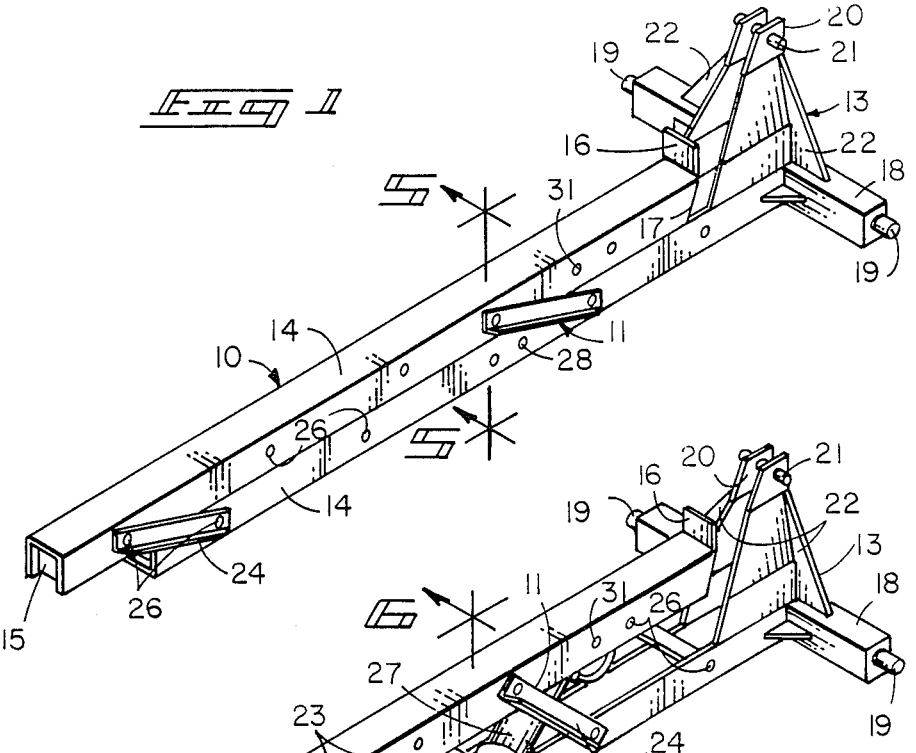
FIG. 1 is an orthographic surface view of my invention in its compressed or relaxed mode showing its various parts, their configuration and relationship.

My pipe expander generally provides a compound arbor formed by similar beams 10 connected by articulating linkage 11 and moved for expansion by hydraulic mechanism 12. Hitch 13 carried by one beam provides means for releasably mounting the expander upon a wheeled tractor (not shown).

Expanding beams 10 comprising similar "U" shaped channel elements 14, the upper element being designated as **14*a* and the lower element as 14*b*. These beams are provided with a plurality of spaced internal septa 15 to aid in maintaining their configuration under load and to provide additional strength and rigidity. The inner end of upper beam 14*a* provides vertically extending pipe stop 16 and end configuration 17** adapted to interfit without interference with the hitch structure carried by the lower beam. The dimensioning of the expanding beams is not particularly critical, but does effect the operation of my invention. The length of the beams must necessarily be as long as a pipe to be expanded by them, and I prefer a beam of about four inch width and depth to provide appropriate strength and rigidity for the beam.

Three-point hitch structrure 13 is carried by the inner end portion of lower channel element **14*b*. This hitch structure provides horizontal arm 18 carrying two similar coaxially aligned lateral hitch pins 19 in each of its end parts. Upstanding medial hitch support 20 carries horizontally extending medial hitch pin 21 in its upper portion. Normally hitch pin 21 is releasably positioned within its supporting structures so that it may be removed to fasten upon the traditional three-point hitch structure of a common wheeled tractor. Various filets 22** are provided in the hitch structure to create appropriate rigidity and strength. This type of three-point hitch has heretofore become well known to attach implements of various sorts to wheeled tractors accommodating such a hitch and its structure and dimensioning have become reasonably well standardized. The hitch is not novel per se, constitutes no essential part of my invention, and therefore is not described in detail.

Articulating linkage 11 that interconnects beams 10 for motion relative to each other provides a plurality of internal links 23 and external links 24, all of a rigid elongate nature. Internal links 23 are rigid flat straps, in the instance illustrated, and the external elements are "L" shaped so-called "angle iron". Each link element is provided with a hole **25*a* inwardly adjacent each of its ends to allow passage of fasteners 26 that communicate through similar cooperating holes 25*b* defined in the opposed legs of beams 10, to pivotally interconnect the link elements with the beam structures. The preferred fasteners are nut-bolt combinations for releasable joinder or rivets for permanent joinder of the interconnected elements, but in either case the fasteners have to be such as to allow pivotal motion between the elements which they interconnect. All fasteners are so defined that fastener holes 25 allow pivotal motion of the fasteners carried therein and so arrayed that all fastening elements are parallel to each other. The connecting linkage elements extend at an angle, preferably of about thirty to forty-five degrees, to the beams when they are adjacent in relaxed condition as shown in FIG. 1**.

Hydraulic mechanism 12 provides hydraulic cylinder 27 pivotally fastened to one expanding beam 10 by pin 28 with extensible piston rod 29 communicating to the other expanding beam where it is pivotally fastened by pin 31 extending between the legs of that beam and fastening yoke 30 carried by the end portion of the piston rod. In the instance illustrated, cylinder body 27 is fastened to lower channel element **14*b* and extensible piston rod 29 is fastened to upper expanding beam 14*a*, but this is not critical to my invention and the piston may operate in either direction relative to these beams. Fastening pins 28, 31 are carried in axially aligned holes defined in each leg of "U" shaped channel elements 14 and the pins are maintained in lateral position relative to the beams by releasable end fixtures (not shown) common for such purposes. Holes are defined in such an array in the channel elements as to cause the axis of hydraulic cylinder 27 to extend at an acute included angle 33 to the beam that is opposite the included angle 34 of the articulated connecting elements 23, 24** to that beam. The degree of angulation of these elements relative to each other is not critical, except that the hydraulic cylinder must be angled oppositely to the connecting links so that the hydraulic cylinder cannot exert forces that would be in the same direction as those links to prevent relative motion of the expanding beams toward and away from each.

Hydraulic cylinder 27 may be of either the single or double acting type, as if it be single acting, the action of gravity on the upper expanding beam will cause the upper beam to move downwardly into immediate adjacency with the lower beam when hydraulic force is removed from the hydraulic cylinder. Hydraulic fixture 35 is carried by an hydraulic hose to extend from the cylinder to interconnect with the releasably fastenable connector (not shown) of a traditional wheeled tractor hydraulic system.

Preferably all of the structural portions of my invention are formed from reasonably strong, durable metallic material, such as mild steel. The fastening of the various elements and parts that is not specified may be accomplished by traditional means. Preferably the connecting linkage is fastened by bolting and the hydraulic linkage by pins having relesable end retaining structures.

Having thusly described the structure of my invention, its operation may be understood.

Firstly, an expander is formed according to the foregoing specification. It is attached to the three-point hitch of a wheeled tractor of commerce by the two lateral hitch pins 19 and medial hitch pin 21. The hydraulic system of my expander is attached to the hydraulic system of the tractor by connector 35. In this condition, the device is ready for operation.

Figure 3:
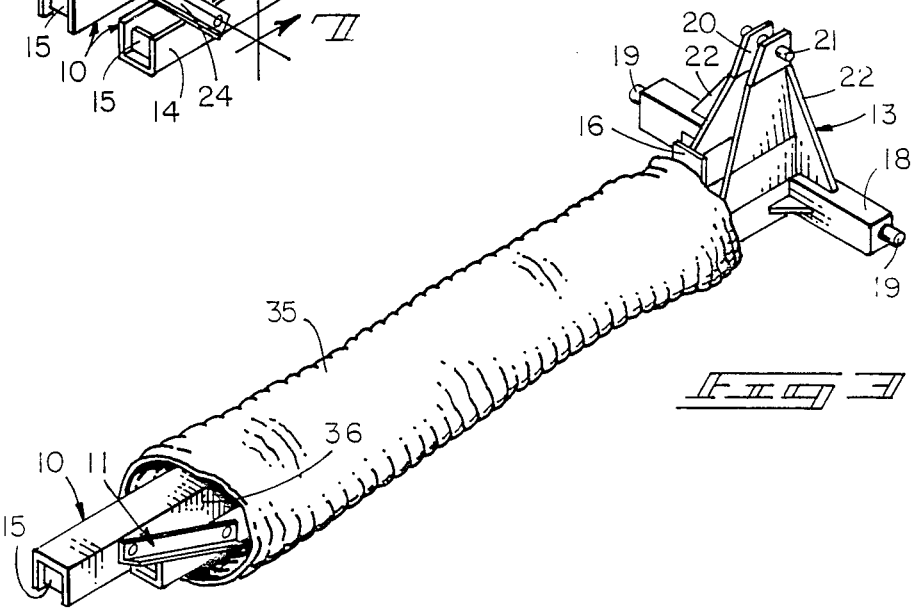
FIG. 3 is an isomertric surface view of my invention inserted within the channel defined by a pipe to be serviced.

The expander is moved to the site of pipe 35 to be serviced by means of the tractor carrying the device for locomotion. My expander is then manipulated by the ordinary and customary manipulation of the three-point hitch of the associated tractor carrying it to bring the expanding arbor to a vertical level from which it may be inserted within channel 36 defined by pipe 35. All traditional three-point hitches allow vertical positioning of the hitch structure and some allow angulated positioning, especially in a vertical plane. Either type of hitch may be readily used with my invention. When the arbor is positioned, it is then moved by the carrying tractor to insert the expandable beams endwise within pipe channel 36, as illustrated in FIG. 3. In this position, the device is ready for use to expand and reform pipe 35.

Figure 2:
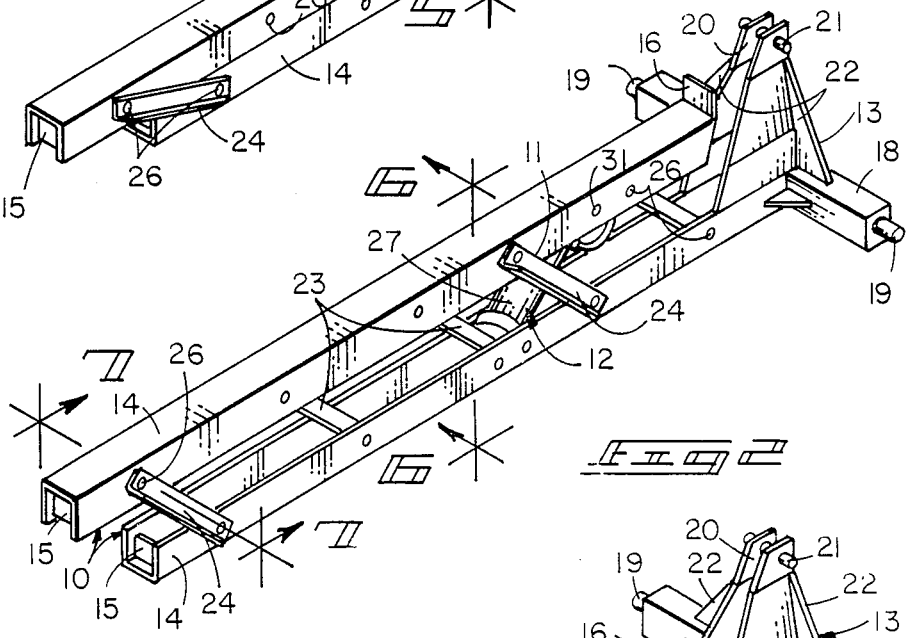
FIG. 2 is a similar isometric view of the device of FIG. 1 showing the same structure in its partially expanded mode.

To accomplish pipe expansion, the hydraulic system of the tractor is activated by switching devices that are a part of it (not shown) to provide pressurized fluid to cylinder 27. As that pressurized fluid is presented to that cylinder, the piston rod is moved axially outwardly from the cylinder. As this occurs, connecting pins 28, 31 interconnecting the ends of hydraulic cylinder 27 with the opposed expanding beams are moved away from each other. This motion provides components in both a direction perpendicular to the expanding beams and also parallel to their axes to cause those beams to move simultaneously both linearly and away from each other, as illustrated in the drawings of FIGS. 2 and 6. The exact motion in either direction may be regulated by known engineering methods by variously determining the geometry of the hydraulic cylinder and articulating connecting linkage relative to each other. The two expanding beams must have a throw or distance between their outer surfaces when expanded as great as the diameter of the largest pipe to be serviced by the device and normally this will be at least 18 or 24 inches. The hydraulic pressure on cylinder 27 is continued until the expanded beams have moved away from each other a distance as great as the diameter of a pipe being operated upon, and possibly a little further, to allow appropriate straightening and tensioning in consideration of the elasticity of the material. At this point when straightening has been accomplished with my device as much as reasonably can be, the hydraulic power presented by pressurized fluid is turned off to relax hydraulic cylinder 27. When this is done, the expanding beams will move back to their normal null position, either by reason of gravity, or in the case of a double acting cylinder by reason of reversed pressure upon the cylinder piston.

The pipe then is rotated slightly upon the arbor by manual manipulation or manipulation of the tractor carrying my device so that the pipe will rest immediately adjacent the first expanded area or in some other area on the pipe requiring straightening, and the process so repeated in the same fashion until the entire piece of pipe is straightened.

When the straightening function is accomplished, the expanding beams are relaxed to their null positions immediately adjacent each other, and the device is extracted from channel 36 of pipe 35 by appropriate manipulation of the tractor and three-point hitch supporting the device. The expander is then ready for reuse in another operation.

From the foregoing description it should be particularly noted that by reason of the geometries involved, channel elements 14 comprising the expanding beams will always move so as to be parallel to each other at any stage of their expansive motion. This is necessarily required by the particular angulated articulating linkage interconnecting the two beams. It is further to be noted that since hydraulic cylinder 27 extends in a direction opposite to that of the articulating connecting links, there is no possiblity that the device can come to a dead center position wherein the two expanding beams will not be moved toward or away from each other upon motion of the hydraulic cylinder.

It is further to be noted that the particular articulating linkage of my invention provides a plurality of spaced links, each of which are always mechanically interconnected between the expanding beams so that there is no unconnected beam section of any substantial length which tends to provide maximum rigidity of the beams throughout their length and avoid problems commonly associated with cantilevered type expanding arbors. This structure also allows construction from lighter and less rigid materials to limit the total mass of the device and also its cost of manufacture.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. An expanding arbor straightening device for relatively thin walled pipe comprising, in combination:

paired opposed elongate rigid expanding beams;

articulating means including plural similar connecting links arrayed in spaced parallel relationship pivotably communicating in angled orientation between said expanding beams to allow the beams to move in constant parallel orientation toward and away from each other;

hydraulic means communicating angularly between said expanding beams at an angle approximately perpendicular to said links to selectively move said beams toward and away from each other.

2. The invention of claim 1 wherein one of said expanding beams carries a three-point hitch structure in its end part, said hitch structure adapted to releasably interconnect with a three-point hitch of a wheeled tractor.

3. The invention of claim 1 wherein:

said connecting links form an acute included angle with the expanding beams of between approximately 30 and 45 degrees, and the hydraulic means comprise an extendible hydraulic cylinder perpendicular the connecting links.

4. An expandable arbor-type pipe straightener for releasable interconnection with a wheeled tractor for operation, motion and locomotion comprising, in combination:

a compound arbor having two similar expanding beams, one of said expanding beams having hitch means in its end part adapted to releasably attach to a three-point hitch structure of a wheeled tractor;

articulating linkage including a plurality of rigid links pivotally interconnected in their end parts respectively to each of said beams and arrayed in a spaced parallel relationship angulated to said beams interconnecting said beam for motion toward and away from each other in a parallel fashion; and hydraulic means including an extendable hydraulic cylinder extending at an angle to said beams opposite that of said rigid links to move said beams selectively toward and away from each other.

* * * * *